US005718400A

United States Patent [19]

Dwy

[11] Patent Number: 5,718,400

[45] Date of Patent: Feb. 17, 1998

[54] TRASH BAG HOLDER WITH HANDLE

[76] Inventor: James Dwy, 4425 E. Riverside Dr., Fort Myers, Fla. 33905

[21] Appl. No.: 720,458

[22] Filed: Sep. 30, 1996

Related U.S. Application Data

[63] Continuation-in-part of Ser. No. 547,010, Oct. 23, 1995, abandoned, and Ser. No. 626,210, Mar. 29, 1996, abandoned.

[51] Int. Cl.[6] ..... B65B 67/04

[52] U.S. Cl. ..... 248/99

[58] Field of Search ..... 248/95, 99, 100, 248/101; 294/114, 55; 141/314, 391

[56] References Cited

U.S. PATENT DOCUMENTS

| | | | |
|---|---|---|---|
| 396,561 | 1/1889 | Harrison | 248/99 |
| 1,373,839 | 4/1921 | Shamblen | 248/101 |
| 1,449,285 | 3/1923 | Hilton | 248/101 |
| 1,468,709 | 9/1923 | Grandeur et al. | 248/101 X |
| 3,754,785 | 8/1973 | Anderson | 248/99 |
| 4,021,994 | 5/1977 | Mainprice | 248/101 X |
| 4,159,139 | 6/1979 | Gawedzinski | 248/101 X |
| 4,445,658 | 5/1984 | Ferron | 248/100 |
| 4,576,350 | 3/1986 | Bond | 248/100 |
| 4,768,742 | 9/1988 | Kaaloa | 248/99 |
| 5,050,920 | 9/1991 | Potticary | 248/100 |
| 5,180,126 | 1/1993 | Bennett | 248/99 |

*Primary Examiner*—Ramon O. Ramirez
*Attorney, Agent, or Firm*—Frank A. Lukasik

[57] ABSTRACT

A trash bag holder which includes a rectangular support frame having a peripheral lip that depends from the frame. An adjustable handle extends outwardly from the support frame. The frame is engaged by a standard plastic trash bag such that the mouth of the bag extends through, wraps over and grips the frame to hold the bag in an open condition. The handle may be set in a near vertical position for loading near the ground, and at 90° to the frame for hanging on a hook mounted on a wall.

3 Claims, 8 Drawing Sheets

TRASH BAG HOLDER WITH HANDLE

This is a continuation-in-part of U.S. application Ser. No. 08/547,010, filed Oct. 23, 1995 and U.S. patent application Ser. No. 08/626,210, filed Mar. 29, 1996, both abandoned.

FIELD OF THE INVENTION

This invention relates to a disposable trash bag holder of the type that would permit a common ordinary plastic trash bag to be held open to enable it to be held in one hand while using it as a portable device. The invention also envisions a built-in hanging option that positions the holder in a stationary, usable position on a wall, but ready to use just by grasping a handle on the holder and taking it.

BACKGROUND OF THE INVENTION

Anyone working alone trying to bag leaves or trash knows the frustration of trying to hold a trash bag and fill it at the same time. The bag is always floppy without support and the bag opening remains small and inaccessible certainly in the initial filling stage. A user has to squat and bend almost constantly, with decreased effectiveness in filling the bag.

An alternative would be to use two persons, but this requires additional manpower and even then the person holding the bag gets hands and arms in the way, which inhibits the filling process. Furthermore, the face of the person holding the bag is never far from the dust and odor of the bag contents. A lot of bending is still required, but again with decreased effectiveness.

Bag holders presently on the market comprise garbage barrels, cans or baskets and the trash bags act as a liner. This combination is more or less stationary and it is necessary to carry disposables to the place where the combination is located. Moreover, such containers are of lesser capacity when compared to an unrestricted bag.

Harrison, in U.S. Pat. No. 396,561 describes a bag holder with a frame comprised of a series of sections hinged together. The frame mechanism is opened and closed horizontally with multiple sections and will hold a bag riveted thereto while filling or removing its contents. It is really not designated for use with disposable bags.

Anderson, U.S. Pat. No. 3,754,785, discloses a portable bag holder for detachably mounting a flexible garbage bag thereon. Tensioning means on the handle of the holder only lightly holds the edges of the bag against the frame. This device would not withstand the weight of a filled bag in upright position when the device is held horizontally. The disposable bag would just slip from the frame.

In Ferron, U.S. Pat. No. 4,445,658 a handled garbage bag is supported on a metal frame. A pivotally secured cover, covers the bag's rim support means and the bag mouth folded thereon. Much like the design used in grocery stores, the hinged top is for a cover only and does not contribute to the support of a disposable bag in any way.

Bond, U.S. Pat. No. 4,576,350 describes a multi-bag supporting stand. The mouths of bags are hung from hooks on the stand while the bottoms of the bags rest on the ground for support. It is not a portable unit while in use. Without the ground support, the bags would tear away while being filled. There are no handles.

Potticary, U.S. Pat. No. 5,050,920, discloses a waste pick up device with handle, rim lips and hooked tabs to the rim to which the mouth of a bag may be hooked. This discloses nothing more than suspending the mouth of a bag from hooks on a rim. mounting and removal would be time consuming and tearing or slipping would be frequent.

SUMMARY OF THE INVENTION

It is therefore an object of the present invention to provide an improved holder for disposable trash bags, which efficiently supports and holds trash bags in an open condition so that it can be used effectively to the full limitations of bag strength.

It is a further object of this invention to provide a trash bag holder with a handle that improves leverage and facilitates holding and carrying in various positions.

It is a further object of this invention to provide that effectively holds a trash bag in an open condition without requiring a clamping mechanism, hooks or other moving parts.

It is a still further object of this invention to provide a trash bag holder that is simpler to operate and construct and is less expensive than anything heretofore available.

A still further object of this invention to provide a trash bag holder that may be produced in several sizes of disposable plastic bags, but which is particularly useful in conjunction with a standard 33 gallon plastic bag.

This invention relates to a trash bag holder, which includes a support frame and means depending from the frame for defining a peripheral lip about the frame. There is a handle extending outwardly from the support frame. The frame is engaged by a standard plastic trash bag such that the mouth of the bag extends through, wraps over and grips the frame to hold the bag in an open condition.

In a preferred embodiment, the frame includes a generally rectangular shape. The frame may comprise a molded tubular element. The lip depending means may include at least one depending element (clamp) that is secured to and depends from the frame. When a rectangular frame is utilized, preferably four depending elements are used, with each depending element being secured to and depending near a respective corner of the frame. Each depending element may comprise a stop post and clamp forming an angle of approximately 90 degrees to the frame such that the depending element generally conforms to its corresponding corner of the frame. The depending elements provide a peripheral lip defining means which may be disposed closer to an inner periphery of the frame than to an outer periphery of the frame. Each depending element may be secured to the frame approximately ½" from the outer periphery of the frame.

The handle includes a brace rotatably mounted on the frame and extending outwardly from the frame and adjustable at an angle greater than 0 degrees and up to 90 degrees. The handle includes a transverse section that interconnects the legs and bears against the user's arm while the user grasps the intermediate section of the frame to provide leveraged support for the frame. The handle may be rotated to a 90° position for engaging a hanger secured to the wall to support the frame in a generally horizontal condition. The handle may be utilized in one of two ways. The transverse section bears against the user's arm while the user grasps the intermediate section of the frame to brace the frame in a generally horizontal condition for upright loading of the refuse. Alternatively, the transverse section may be directly grasped such that the frame is suspended in a generally vertical condition for sweeping or raking refuse into the attached bag.

Other objects, features and advantages will occur from the following description of preferred embodiments and the accompanying drawings, in which:

DETAILED DESCRIPTION OF THE PREFERRED EMBODIMENT

Figure 1:
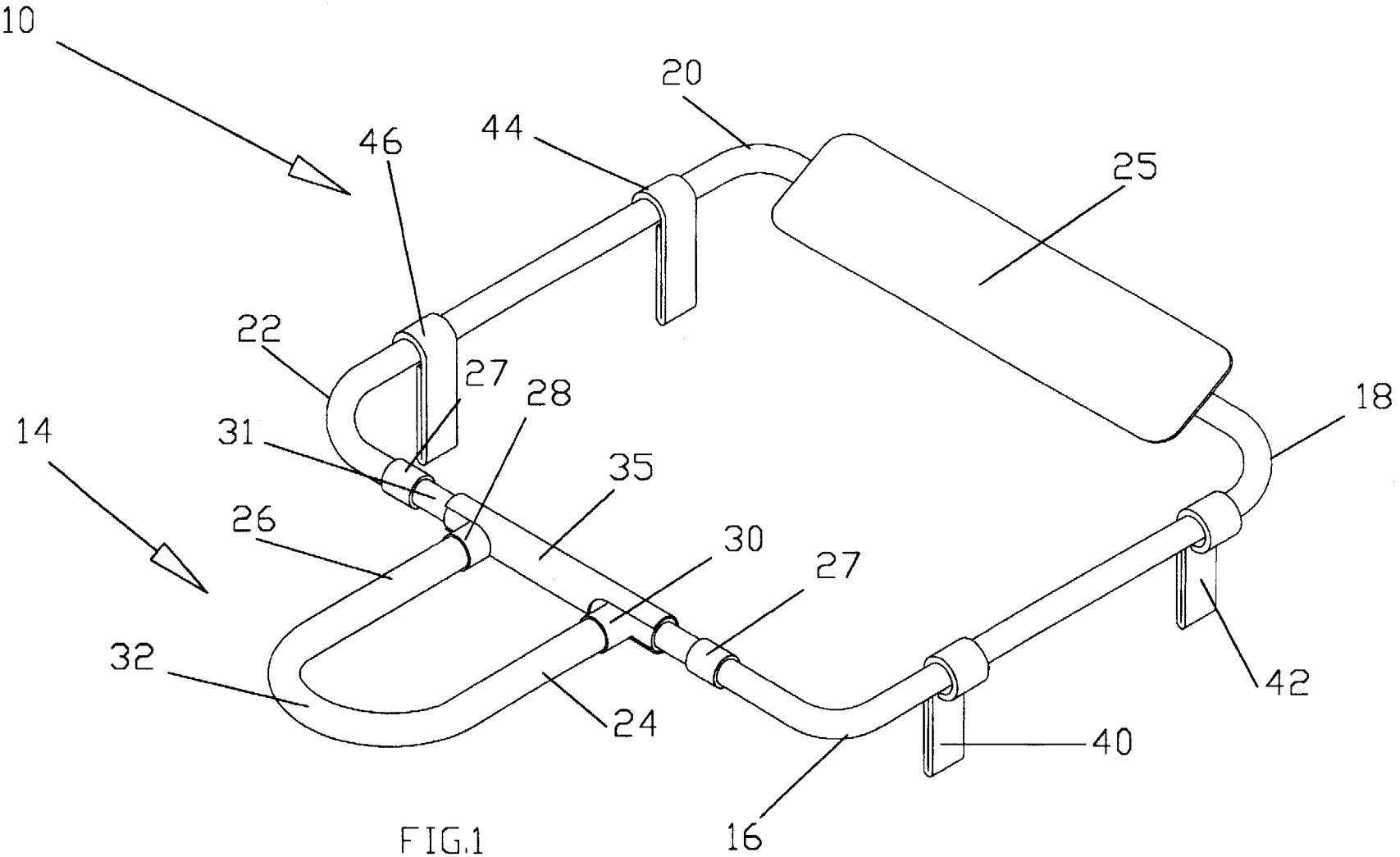
FIG. 1 is a perspective view of an improved trash bag holder according to this invention.
Figure 2:
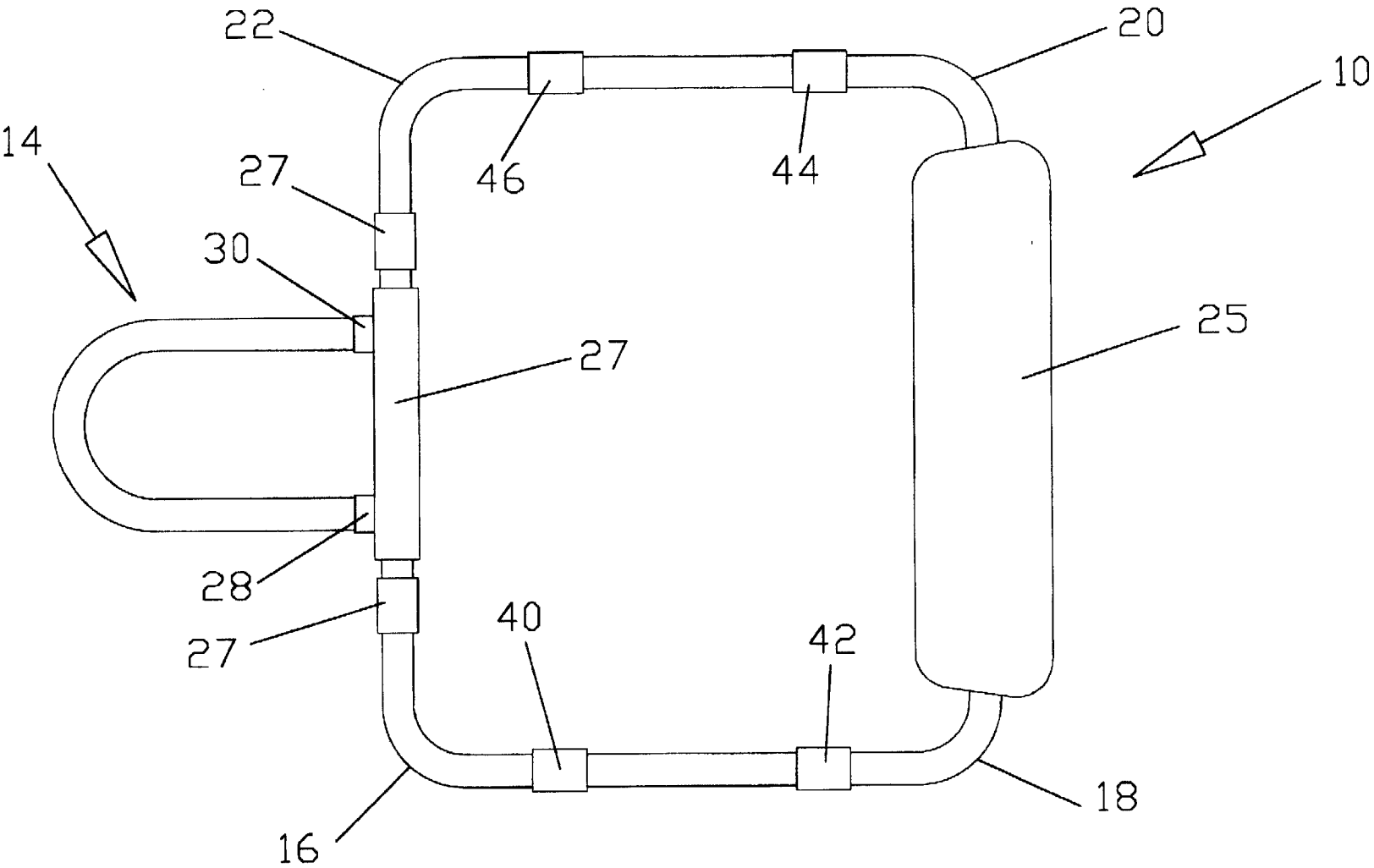
FIG. 2 is a plan view of the trash bag holder.
Figures 3, 4:
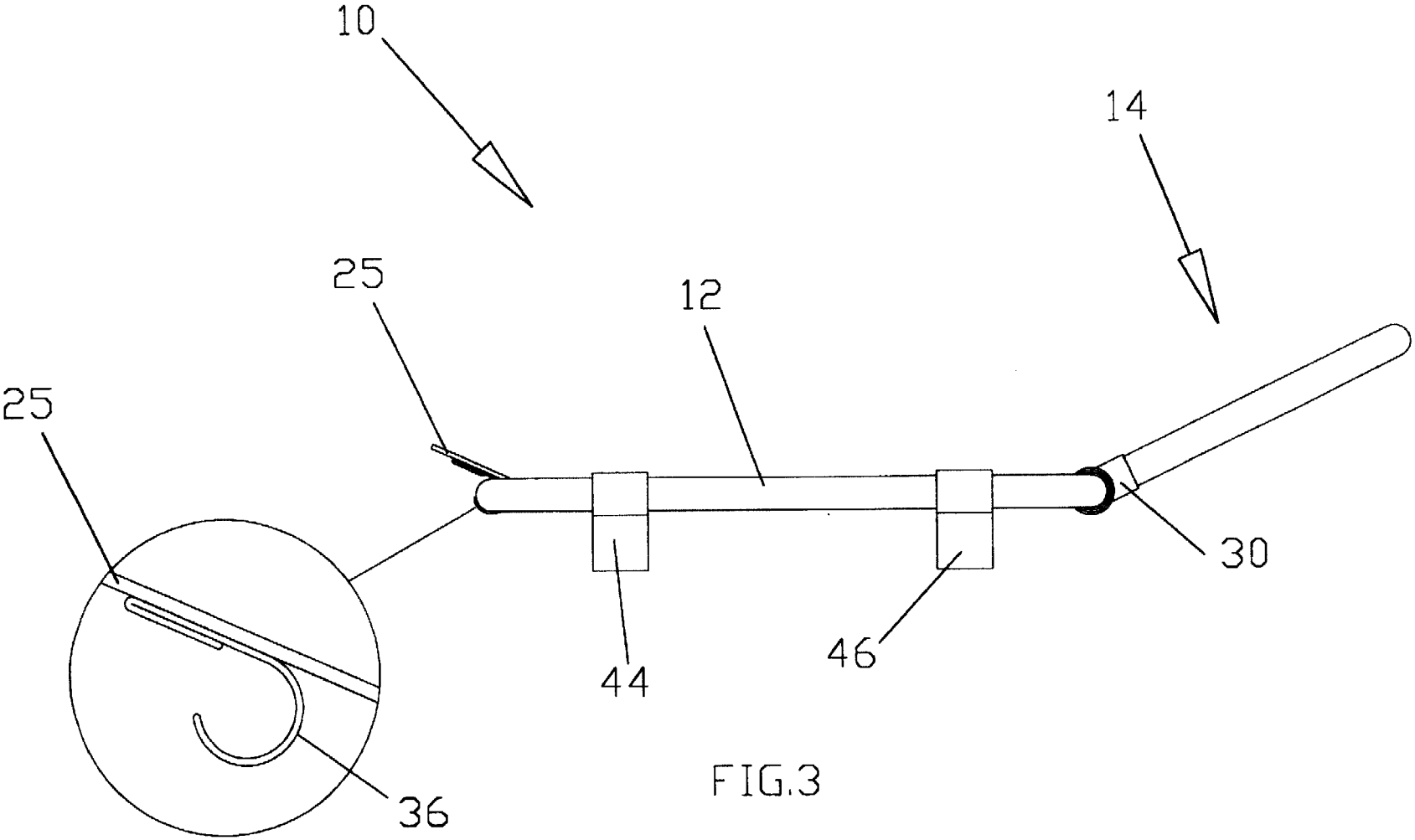
FIG. 3 is a side elevational view of the holder.
FIG. 4 is an expanded view of one of the mounting clips secured to the back of the dust ramp.

There is shown in FIGS. 1–3 a trash bag holder 10, which includes a generally rectangular support frame 12 and a handle 14 that is interconnected to and extends outwardly and upwardly from frame 12 and a dust ramp 25. Frame 12 and handle 14 normally comprise a molded plastic tubing formed of PVC or a similar material. Various non-plastics such as fiberglass, aluminum or composites may also be used. The frame includes rounded corners 16, 18, 20, and 22. Handle 14 has a generally U-shaped configuration and includes a pair of legs 24 and 26 that are interconnected to frame 12 by respective PVC "T" connectors 28 and 30. A transverse handle section 32 interconnects the opposite ends of legs 24 and 26. As best shown in FIG. 3, handle 14 extends upwardly from the plane of frame 12 at an angle of approximately 30 degrees. This angle may be varied within the scope of this invention. Normally, it is below 45 degrees but may be anywhere between zero degrees and 90 degrees.

Figure 7:
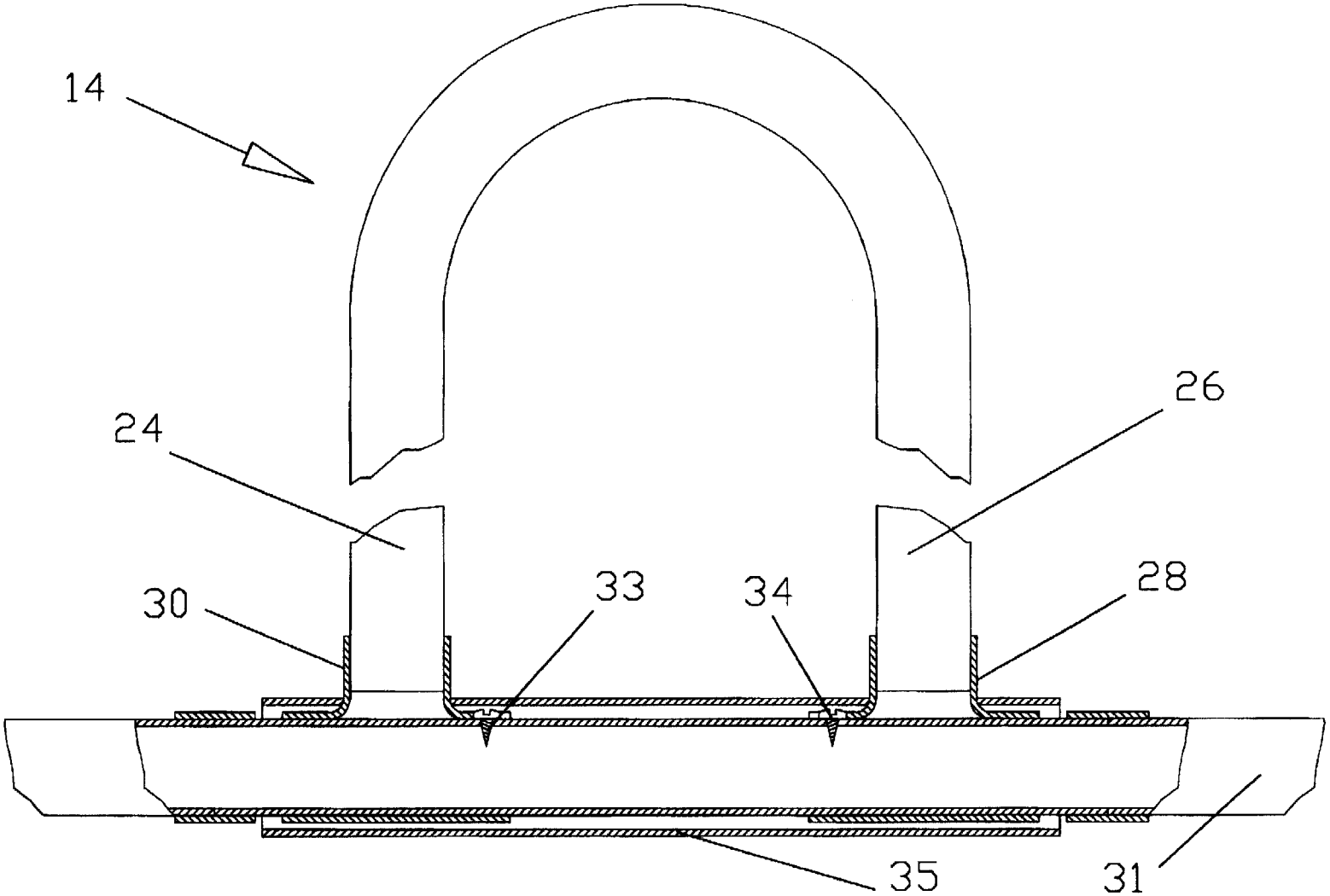
FIG. 7 is a cutaway section of the handle assembly of the invention.
Figure 8:
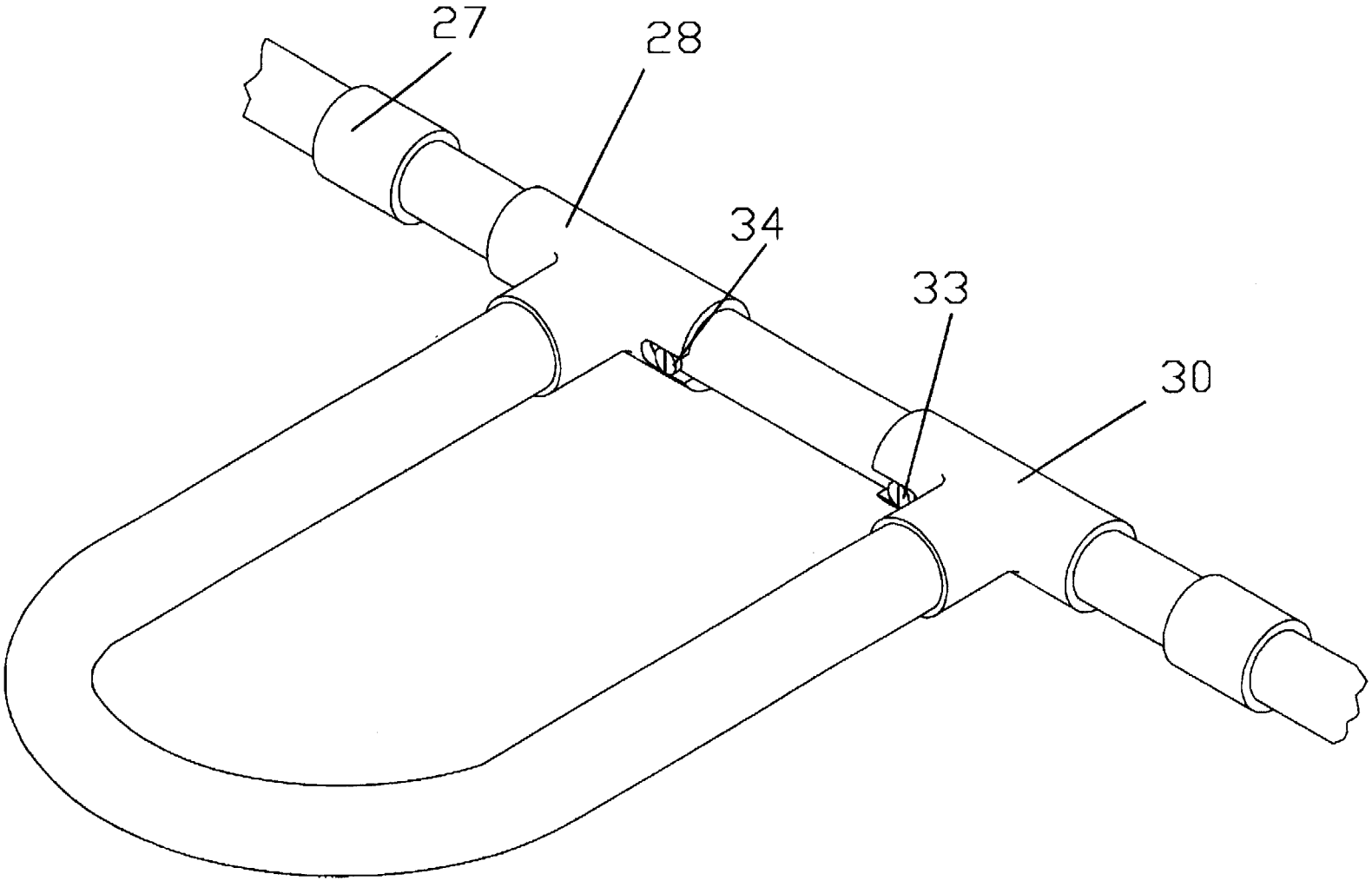
FIG. 8 is an expanded cutaway section of the handle pivoting system.
Figure 9:
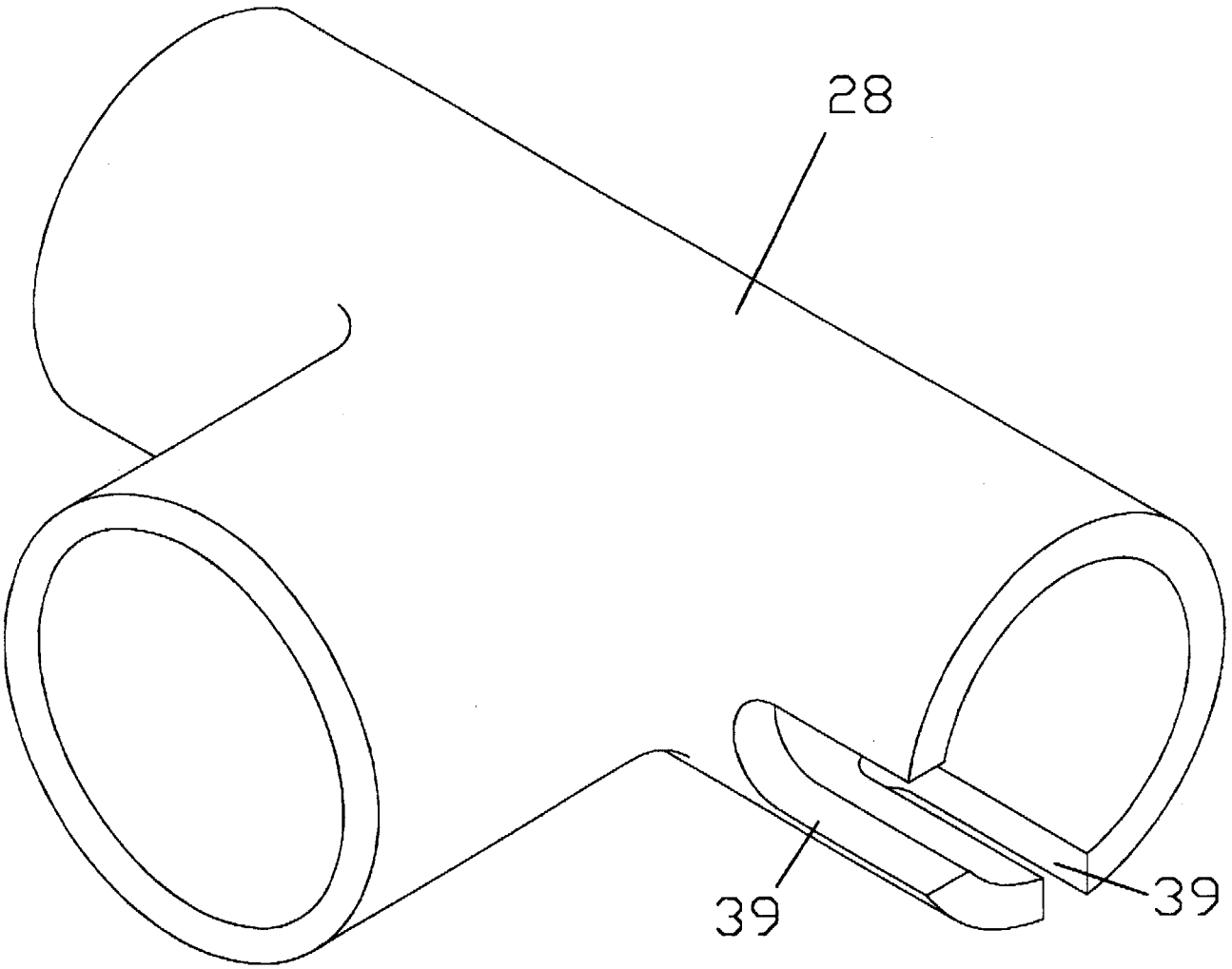
FIG. 9 is a perspective view of the locking grooves for the handle.

As seen in FIGS. 7–8, the connectors 28 and 30 are pivotally mounted on frame 12, section 31. Screws 33 and 34 are fastened through section 31 to act as stops for setting the angle of handle 14. Section 31 is affixed to frame 12 with collars 27 after connectors 28 and 30 are pivotally assembled. Notches 39 are formed in connectors 28 and 30 to engage screws 28 and 30 to set the angle of handle 14. The angle of handle 14 is adjusted by gripping the legs 24 and 26 on handle 14 and spreading the legs 24 and 26 until the screws 33 and 34 are clear of the slots 39. A collar 35 is disposed on section 31 between legs 24 and 26. Slots 50 are provided on each end of collar 35 to act as guides for the connectors 28 and 30 when the handle 14 angle is being set.

Means are provided for forming a depending peripheral lip at each corner of the frame 12. Such means comprise four depending elements, stop post and clamps 40, 42, 44, and 46, the clamp elements are likewise composed of a light-weight plastic or other material that may be identical or quite similar to the material composing the frame 12 and handle 14. The clamps 40, 42, 44, and 46 may be formed unitarily with frame 12 when the frame 12 is molded or otherwise constructed. Alternatively, the clamp elements may be secured to the frame 12 after it is manufactured as by mounting the "C" shaped end with cement on the frame 12 during fabrication or molding.

In the rectangular embodiment illustrated herein, four clamp elements are employed; one depends near each of the corners 16, 18, 20, and 22. In alternative embodiments, the lip may be formed by a single continuous flange element or other numbers of flange elements, posts or other members disposed about and depending from the frame.

Figure 5:
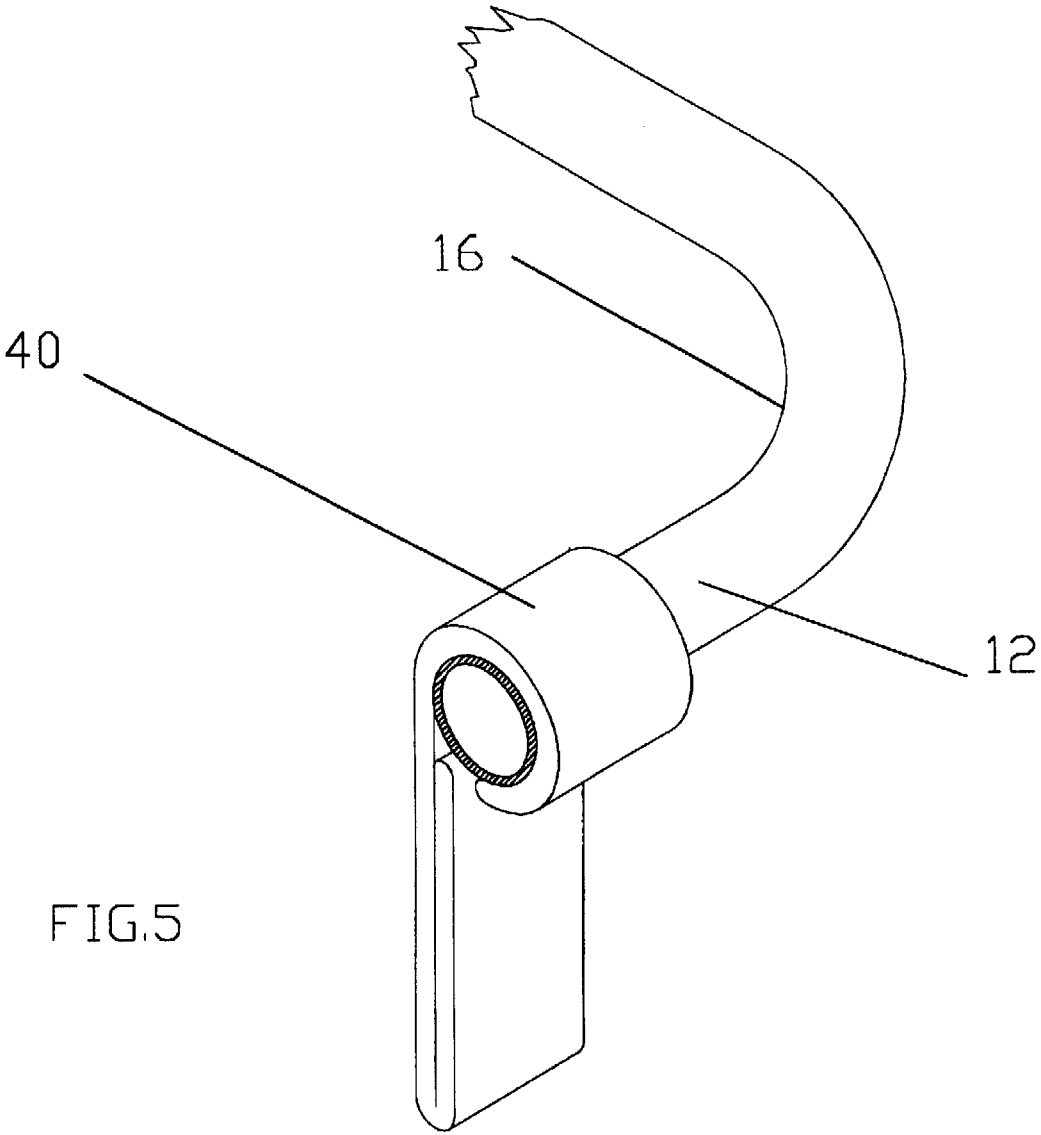
FIG. 5 is a perspective view, partially in section of a depending element secured to the frame.

A representative one of a clamp element 40 is shown in FIG. 5. Clamp element 40 is associated with and attached vertically near corner 16 of frame 12. The clamp element 40 is bent in an arc at one end, with the inner diameter equal to the outer diameter of frame 12. As best illustrated in FIG. 5, the clamp element 40 is disposed closer to the inner periphery of the frame 12 than to the outer periphery. In one version of this invention, the frame is constructed of approximately ¾" PVC tubing. It should be noted that various other dimensions may be employed for the frame and for the position of which the clamp elements are fixed. However, in any case, the clamp elements are preferably set back from the outer periphery of the frame 12 so that improved, secure, bag gripping benefits are achieved in the manner described more fully below.

It should also be noted that the remaining clamp elements 42, 44, and 46 are secured to and oriented with corners 18, 20, and 22 respectively, in a manner similar to that shown in FIG. 5.

Figure 6:
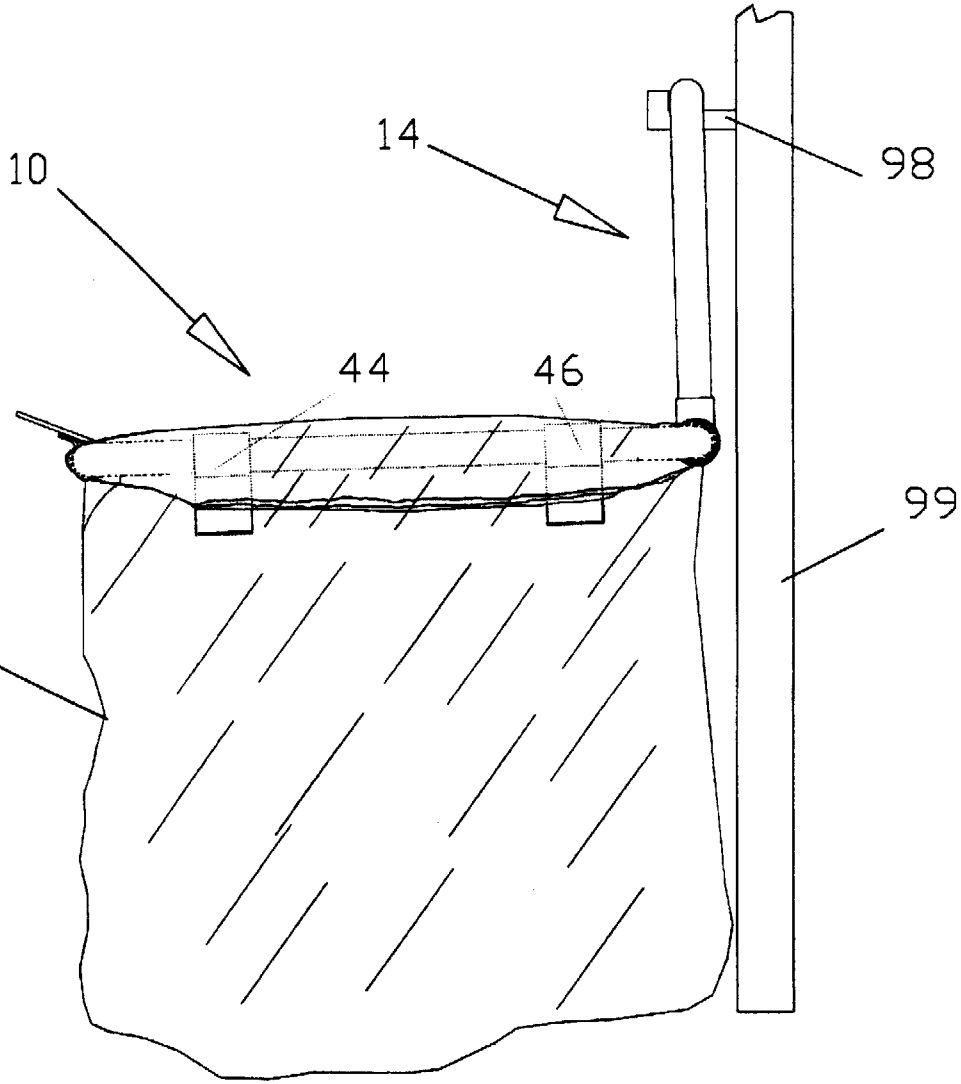
FIG. 6 is a side view of the trashbag holder mounted in hanging position.

As shown in FIG. 6, the invention 10 is is shown in the wall mounting position of the handle 14 showing a plastic bag 70 secured to the holder 10 and held in an upright, open condition so that the bag 70 may conveniently be filled. Initially, a bag 70 having an opening with a normal, unstretched circumference slightly less than the outer peripheral length of frame 12 is attached to holder 10. Various sizes of frames 12 and bags 70 may be used, although a frame 12 slightly larger than the opening of a standard 33 gallon plastic bag 70 is preferred. Attachment of the bag 70 is accomplished by simply grasping bag 70 and introducing the upper end of the bag through frame 12. The mouth of the bag 70 is then wrapped over the outer periphery of the frame 12. First the bag 70 is wrapped over any three of the corners 16, 18, 20, and 22. Then the mouth is stretched over the fourth corner of the frame 12. As a result, open upper end of bag 70 is wrapped over and snugly gripped by the frame 12. The upper end is disposed about the frame 12. Because the mouth of the bag 70 is stretched, the very upper edge is pulled snugly beneath the frame 12 corners and against the clamp elements 40, 42, 44, and 46.

A fairly short portion of the upper end of the bag 70 remains inside the frame 12 and is prevented from wrapping over the frame 12 by connectors 28 and 30.

Dust ramp 25 is generally rectangular shaped and may be made from a relatively thin sheet of plastic material similar to the material used to make frame 12. The two clamps 51 may be of the type which are permanently fastened to ramp 25 by adhesive and are generally "C" shaped with an extension for fastening to the dust ramp 25. The dust ramp 25 may be clipped to the frame 12 by slipping it over the stretched opening of the bag 70, and the dust ramp 25 may be removed when desired.

The downwardly extending clamps 40, 42, 44, and 46, securely hold the bag 70 in place and prevent the mouth of the bag from slipping off the respective corners as the bag is filled with refuse. Without the clamps or some other form of lip or post means depending from the frame 12, the upper end of the bag 70 at one corner would tend to be pulled further under the frame 12. This would produce slack in the mouth of the bag 70 at an opposite portion of the frame 12, which would likely cause the bag 70 to slip loose from the frame 12 when a downward force is exerted on the bag 70. The clamp elements prevent this effect. The clamps or other downward protrusions need not have any particular shape or size. They need only be constructed to restrict the upper edge of the bag 70 to a circumference slightly less than the outer periphery of the frame 12.

Bag 70 is gripped securely open in the above manner without the requirement of a clamp or any other moving parts. A user holds the bag 70 in a horizontal condition of FIG. 3 by grasping the collar 35 of frame 12 from below. The upper transverse portion 32 of handle 14 engages the user's arm and provides effective leverage so that the entire frame can be easily supported in the horizontal position and in a generally vertical position with the sweeping dust ramp 25 touching the ground (not shown). The frame 12 can thereby be held comfortably in an angled position with the opening in a position to be filled by raking or sweeping the refuse over the sweeping dust ramp 25 and into the bag 70, thereby using the frame 12 in a manner of a dust pan. The relatively insignificant weight of holder 10 and bag 70 make it easy to maintain the bag 70 in this condition. The user can then fill the bag with trash, leaves, or other refuse as required. Refuse can be collected quickly and comfortably without stooping and without the requirement of an assistant to hold the bag open.

After refuse collection is completed, the user removes the bag 70 from frame 12 by simply grasping the bag 70 near a corner of the frame, then slipping the upper edge of the bag 70 off the frame. This completely releases the bag 70 from the fame 12 and the refuse can be disposed in a conventional manner. A new bag 70 can be fitted onto holder 10 in the above manner.

Between uses, holder 10 may be stored with the handle as shown in the position shown in FIG. 6 by merely hanging it on a wall hook 98.

Accordingly, the present invention provides a simple, inexpensive and yet highly effective holder for collecting and disposing of leaves, refuse or trash. By using a rake or a broom, holder 10 allows the user to sweep some types of debris directly into the bag 70 without bending, stooping or coming in direct contact with unpleasant refuse. Additionally, the holder allows the user to single-handedly carry and fill a trash bag 70 with ease. The bag may be held in a useful, open position for filling, and may also be either mobile or stationary.

The holder 10 is particularly useful for policing a yard, bagging leaves, collecting refuse or trash. It is also useful in custodial work such as cleaning floors and driveways. commercial applications include roadside cleanup. The holder 10 may be used advantageously when cleaning up after a party, or when an animal has knocked over garbage. Also, three or more holders 10, hung on a wall (such as in a garage) provide a perfect way to separate and bag recyclables so that they do not have to be re-handled The holder 10 can support a full bag 70 without slippage and tearing. It is a simple procedure to remove a filled bag 70 and reinstall another. The bag 70 is secured tightly and without the need for tools. The bag 70 is held wide open and the user may move about freely. The holder 10 is weatherproof and will not rust or corrode.

Normally a person may use a trash bag by placing it inside a garbage can. Then, when the bag is filled, one has to lift the bag out of a can. If the debris is heavy or the bag packed too taut, the bag may be too heavy to lift or may tear. Sometimes it is impossible to remove the bag without dumping the entire can. With the instant invention, when the bag filled and released from the holder 10, it remains in place and intact without tearing.

The instant invention does not require the employment of a garbage barrel, can or basket. It is therefore easier to move the bag and the capacity of the trash bag is not lessened, as it would be the case if the bag were placed inside a container, where capacity would be restricted by the container.

The holder 10 of the present invention offers more flexibility for practical uses of everyday tasks and chores related to maintenance. This holder 10, however, can be made in different sizes and shapes; i.e., oval, circular, triangular, or rectangular. The holder 10 works in both horizontal and vertical positions and bags can be dragged across the ground when heavily filled without slipping from the grasp of the mechanism.

It should be further noted that, as in the co-pending application, a sweeping ramp 25 may be snapped or otherwise attached to the edge of the frame 12 to facilitate the sweeping of debris into the bag 70. Such a ramp also guards the lower edge of the disposable trash bag from damage from the rake or debris entering the bag 70. Other features, elements and advantages disclosed in the referenced co-pending application may also apply to the present invention.

Although specific features of the invention are shown in some drawings and not others this is for convenience only, as each feature may be combined with any or all of the other features in accordance with the invention. Other embodiments will occur to those skilled in the art and are within the following claims.

What is claimed is:

1. A trash bag holder comprising:

a support frame, means depending from said frame for defining a peripheral lip about said frame for engaging a standard trash bag such that the mouth of the trash bag extends through, wraps over and grips said frame to hold the bag in an open condition, and an adjustable handle extending outwardly from said support frame for holding said support frame at various selected angles, said handle having a pair of legs secured to said frame and being spaced apart to bound an intermediate section of said frame that may be grasped by a user, said handle further having a transverse section that interconnects said legs and bears against the user's arm while the arm grasps said intermediate section of said frame to provide leveraged support for said frame, said handle extending upwardly from said frame at an angle greater than zero degrees and up to ninety degrees, and a ramp clamped onto said frame opposite to said handle for sweeping debris into said frame held bag.

2. A trash bag holder comprising:

a rectangular plastic tube support frame, said frame having a plurality of position setting screws, four depending clamp elements, each depending clamp element being secured to and depending near a respective corner of said rectangular frame, said clamp elements defining a peripheral lip about said frame for engaging a standard trash bag such that the mouth of the trash bag extends through, wraps over and grips said frame to hold the bag in an open condition, an adjustable handle pivotally mounted on and extending outwardly from said support frame at various selected angles, said handle having a pair of legs pivotally mounted on said frame and being spaced apart to bound an intermediate section of said frame that may be grasped by a user, said handle further having a transverse section that interconnects said legs and bears against the user's arm while the arm grasps said intermediate section of said frame to provide leveraged support for said frame, and said handle having a plurality of grooves for cooperating with said position setting screws for determining operating positions of said handle, and a ramp clamped onto said frame opposite to said handle for sweeping debris into said frame held bag.

3. The holder of claim 1 in which said handle extends upwardly from said frame at an angle greater than zero degrees for near vertical loading and up to ninety degrees for engaging a complimentary component secured to a wall for supporting said frame in a generally horizontal condition.

* * * * *